US007744207B2

(12) United States Patent
Iwase

(10) Patent No.: US 7,744,207 B2
(45) Date of Patent: Jun. 29, 2010

(54) INK JET PRINTER

(75) Inventor: Fumiyoshi Iwase, Hamamatsu (JP)

(73) Assignee: Roland DG Corporation, Hamamatsu-shi (JP)

( * ) Notice: Subject to any disclaimer, the term of this patent is extended or adjusted under 35 U.S.C. 154(b) by 322 days.

(21) Appl. No.: 11/743,244

(22) Filed: May 2, 2007

(65) Prior Publication Data

US 2008/0170104 A1 Jul. 17, 2008

Related U.S. Application Data

(62) Division of application No. 10/809,892, filed on Mar. 25, 2004, now Pat. No. 7,232,212.

(30) Foreign Application Priority Data

Nov. 11, 2003 (JP) ..... 2003-381058

(51) Int. Cl.
*B41J 2/01* (2006.01)

(52) U.S. Cl. ..... 347/102; 347/101

(58) Field of Classification Search ..... 347/102, 347/101; 101/488; 219/216; 346/25
See application file for complete search history.

(56) References Cited

U.S. PATENT DOCUMENTS 4,739,415 A 4/1988 Toyono et al.
6,145,979 A 11/2000 Caiger et al.
6,163,036 A 12/2000 Taninaka et al.
6,457,823 B1 10/2002 Cleary et al.
6,525,752 B2 2/2003 Vackier et al.
6,536,889 B1 3/2003 Biegelsen et al.
6,561,640 B1 5/2003 Young
6,783,227 B2 8/2004 Suzuki et al.
7,249,836 B2 7/2007 Yokoyama
2002/0034594 A1* 3/2002 Shiveley ..... 427/558
2002/0044188 A1* 4/2002 Codos ..... 347/106
2002/0140794 A1 10/2002 Asano et al.
2002/0175984 A1* 11/2002 Ylitalo et al. ..... 347/102
2003/0035037 A1 2/2003 Mills et al.
2003/0164870 A1 9/2003 Yamamoto
2003/0184631 A1 10/2003 Suzuki et al.
2003/0184632 A1* 10/2003 Suzuki et al. ..... 347/102

(Continued)

FOREIGN PATENT DOCUMENTS

JP 10190058 A 7/1998

(Continued)

OTHER PUBLICATIONS

U.S. Office Action for corresponding U.S. Appl. No. 11/743,342, dated Feb. 1, 2010, pp. 1-27.

(Continued)

*Primary Examiner*—Stephen D Meier
*Assistant Examiner*—Leonard S Liang
(74) *Attorney, Agent, or Firm*—Ditthavong Mori & Steiner, P.C.

(57) ABSTRACT

An ink jet head (15) of an ink jet printer comprises an ink jet nozzle (24) outputting ultraviolet curing ink, a pair of ultraviolet LEDs 25*a* and 25*b* provided on both sides of the ink jet nozzle in the moving direction for emitting ultraviolet in order to cure the ultraviolet curing ink.

4 Claims, 5 Drawing Sheets

U.S. PATENT DOCUMENTS

| | | | | |
|---|---|---|---|---|
| 2004/0036753 | A1 | 2/2004 | Hirai | |
| 2004/0114017 | A1* | 6/2004 | Yokoyama | 347/102 |
| 2004/0164325 | A1* | 8/2004 | Siegel | 257/200 |
| 2006/0121208 | A1* | 6/2006 | Siegel | 427/487 |

FOREIGN PATENT DOCUMENTS

| | | | |
|---|---|---|---|
| JP | 15 2003-145725 | | 5/2003 |
| JP | 2003145741 | A | 5/2003 |
| JP | 2003-191594 | A | 7/2003 |
| JP | 2003-192962 | A | 7/2003 |
| JP | 2003191507 | A | 7/2003 |
| JP | 2003191593 | A | 7/2003 |

OTHER PUBLICATIONS

U.S. Office Action for corresponding U.S. Appl. No. 11/743,342, dated Mar. 31, 2009, pp. 1-19.

* cited by examiner

FIG. 6A
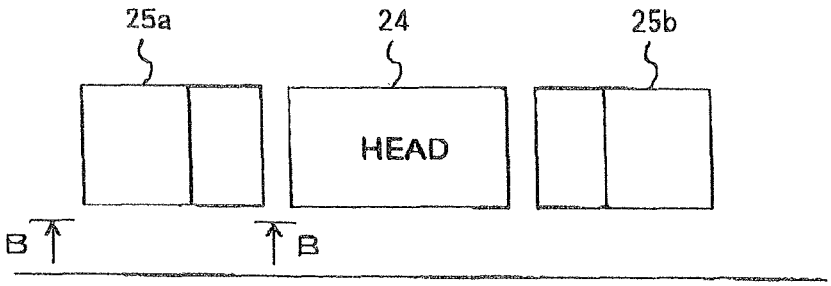
FIG. 6B
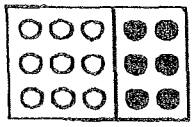
FIG. 7A
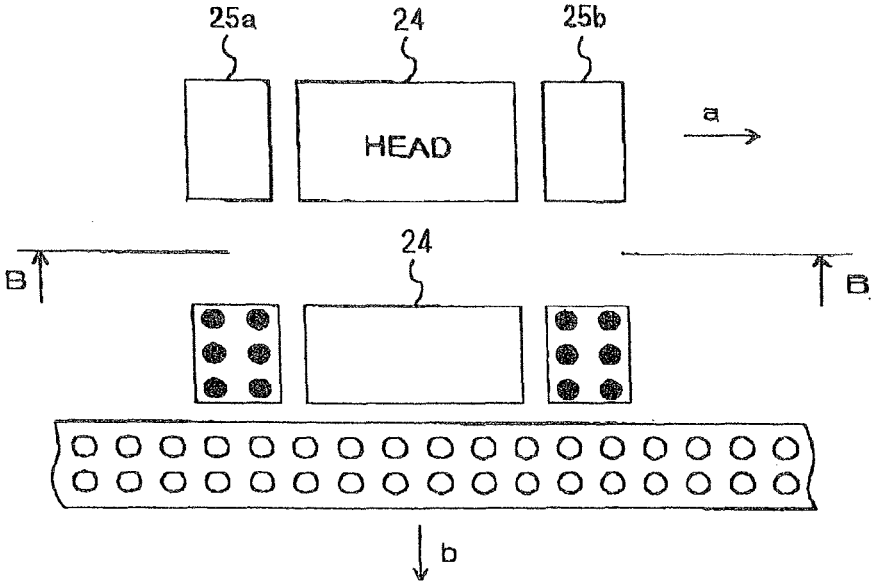
FIG. 7B

INK JET PRINTER

RELATED APPLICATIONS

The present application is a divisional application of U.S. patent application Ser. No. 10/809,892 filed on Mar. 25, 2004, now U.S. Pat. No. 7,232,212 the contents of which are hereby incorporated by reference. The present application is also related to U.S. application Ser. No. 11/743,342 filed May 2, 2007.

BACKGROUND OF THE INVENTION

1. Field of the Invention

The present invention relates to an ink jet printer using ultraviolet curing ink and more particularly, it relates to an ink jet printer using ultraviolet curing ink, which has a long life.

2. Description of the Background Art

The conventional ink jet printer is disclosed in the following patent document 1, for example. FIG. 8 is a view showing an essential part of the conventional ink jet printer using ultraviolet curing ink.

According to the ink jet printer using the ultraviolet curing ink, the ultraviolet curing ink is applied onto a recording medium such as a recording sheet, and the ultraviolet curing ink is cured and fixed on the recording medium by irradiation of ultraviolet (UV) to form an image.

Referring to FIG. 8, a conventional ink jet printer 101 using the ultraviolet curing ink, comprises a ink nozzle 103 mounted on an ink jet head 102, scanning a recording sheet (recording medium) P in accordance with the movement of the ink jet head 102 and jetting out ultraviolet curing ink (referred to as ink also hereinafter) on the recording sheet P, a ultraviolet lamp 104 emitting ultraviolet to cure and fix the ultraviolet curing ink emitted from the ink nozzle 103 and applied to the recording sheet P, an ink tank 105 containing ink before supplied to the ink nozzle 103, a guide rail 106 guiding the ink jet head 102 along the longitudinal direction (along the direction shown by arrow A or B) when the ink jet head 102 is moved, conveying means (not shown) for conveying the recording sheet P at the time of recording, a maintenance unit 110 performs maintenance for the ink nozzle 103, a home position (not shown) in which the ink jet head 102 is in a standby state, a controller (not shown) controlling each component and the like.

In this example, the ink jet head 102 comprises four ink nozzles each for each color used in printing, two ultraviolet lamps 104 (provided on both sides of the ink jet head 102 in the scanning direction) and the like. Each ink nozzle 103 comprises an outlet (not shown) from which the ultraviolet curing ink corresponding to each color is jetted out, at a lower face, for example. In addition, the ultraviolet lamp 104 emits ultraviolet in the downward direction also, for example.

The maintenance unit 110 comprises a suction cap 171 covering the lower surface of the ink nozzle 103 and sucking ink from the outlet in a sealed state, a drip cap 172 dripping the ink jetted out by air jetting of the ink from the outlet to a waste ink tank 175 positioned at lower part of the maintenance unit 107, after the ink was sucked by the suction cap, and a blade 173 cleaning off the ink remaining at the outlet of the ink jet head 3 after the air jetting was performed on the drip cap 172. The suction caps 171 are arranged so as to be able to suck the plural number of ink nozzles 103 simultaneously at the time of maintenance. In addition, the maintenance unit 107 comprises a suction pump 174 as means for sucking the ink nozzle 103. The ink sucked from the outlet by the suction pump 174 is also dripped into the waste ink tank.

In addition, the maintenance unit 110, the suction cap 171, the drip cap 172 and the blade are made of a rubber.

[Patent Document 1] Japanese Unexamined Patent Publication No. 2003-145725 (paragraph number [0007], [0008] and [0011], FIG. 1)

According to the conventional ink jet printer using the ultraviolet curing ink, since an ultraviolet emission lamp for emitting ultraviolet is used, the lamp cannot be easily turned off and the lamp has to be kept on while used in general. Therefore, there is a problem that power consumption is large.

In addition, there is a problem that it takes time to light the ultraviolet lamp at the time of start, so that it takes time until the printing starts.

Furthermore, since the ink nozzle is capped at the maintenance unit 110 while the ultraviolet lamp is on, the capping rubber deteriorates by the ultraviolet and heat and its life becomes short.

Still further, even when the lamp is turned off at the maintenance part, there is a problem that the capping rubber deteriorates, the sheet medium gets burned, warps or expands by the heat of the lamp.

SUMMARY OF THE INVENTION

The present invention was made in order to solve the above problems and it is an object of the present invention to provide an ink jet printer using ultraviolet curing ink, which contributes to energy saving, is quick to start and has a long life.

An ink jet printer forming an image using ultraviolet curing ink according to the present invention comprises an ink jet head jetting out the ultraviolet curing ink onto a predetermined sheet, moving means for moving the ink jet head relatively to the sheet and an LED provided in the moving direction of the ink jet head and emitting ultraviolet ray.

According to the present invention, the light source for irradiating the ultraviolet curing ink is the LED which emits ultraviolet. Since the LED is used, the power consumption is not so large as in conventional example and since the heat is not provided, the rubber does not deteriorate nor the medium is not adversely affected by the heat.

Still further, since the LED has a short wavelength, it does not contain light which has a long wavelength and becomes an unnecessary heat source, so that the printing medium is not adversely affected and measurement to radiate the heat of the ink jet printer and the like is not necessary.

As a result, there can be provided the ink jet printer which can contribute to the energy saving, be quick to start and have a long life. In addition, since the lamp is not used, it becomes a compact apparatus.

Preferably, the LED is provided also in the direction opposite to the moving direction of the ink jet head.

Still preferably, the LED comprises a plurality of LED elements arranged in rows and columns, and the plural LED elements comprise first-wavelength LED elements outputting first-wavelength ultraviolet, and second-wavelength LED elements outputting ultraviolet whose wavelength is longer than the first wavelength.

Still preferably, the LED comprises a plurality of first-wavelength LED elements and second-wavelength LED elements, and the plural first-wavelength LED elements and second-wavelength LED elements are arranged alternately in the moving direction.

Still preferably, the plural first-wavelength LED elements of the plural first-wavelength LED elements and second-wavelength LED elements are arranged close to the side of the ink jet head.

Still preferably, the moving means moves the ink jet head in the main scanning direction which is a conveyance direction of the sheet, and in the secondary scanning direction which intersects with the conveyance direction of the sheet at right angles, and the plural first-wavelength LED elements are arranged in the secondary direction of the ink jet head and the plural second-wavelength LED elements are arranged on the main scanning side of the ink jet head.

BRIEF DESCRIPTION OF THE DRAWINGS

FIGS. 6A and 6B are views showing an exemplary arrangement of ultraviolet irradiation LED elements;

FIGS. 7A and 7B are views showing an exemplary arrangement of ultraviolet irradiation LED elements.

DESCRIPTION OF THE EMBODIMENTS

One embodiment of the present invention is described with reference to the drawings hereinafter.

Figure 1:
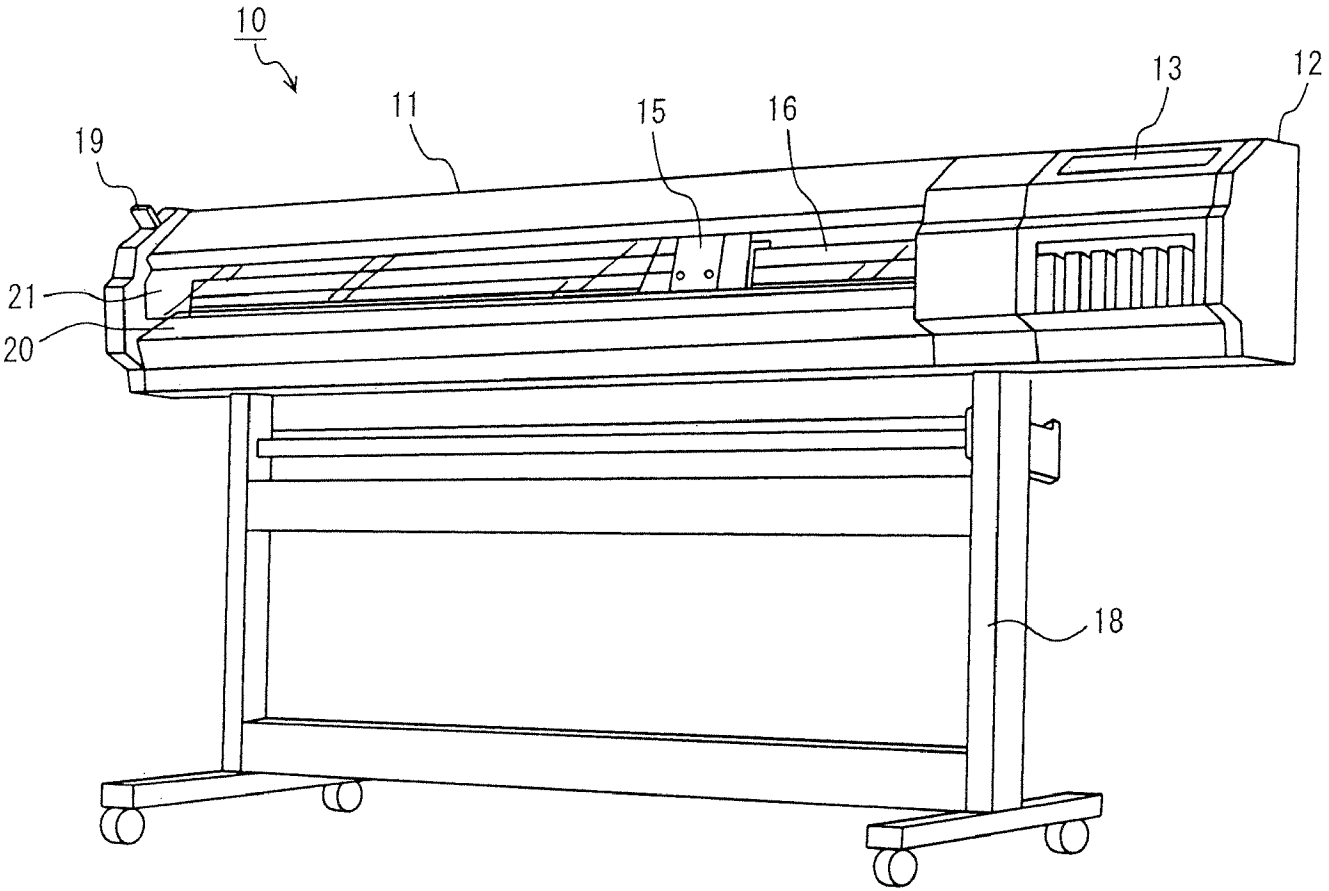
FIG. 1 is a view showing an outline of an ink jet printer according to one embodiment of the present invention.

FIG. 1 is a schematic view showing a whole constitution of an ink jet printer using ultraviolet curing ink according to this embodiment of the present invention.

Referring to FIG. 1, an ink jet printer 10 comprises a body 11 and legs 18 supporting the body 11. The body 11 comprises an ink jet head 15 outputting the ultraviolet curing ink, a guide rail 16 serving as a guide when the ink jet head 15 is moved in the secondary scanning direction, that is, the longitudinal direction in FIG. 1, an operation panel 13 provided at one end of the body 11 and a side cover 12 provided at both ends of the body 11.

A front cover 21 is provided at the front of the body 11 and a platen 20 is provided at a lower part of the ink jet head 15. A pinch roll lever 19 for pinching a sheet (not shown) with a pinch roll (not shown) on the platen 20 at the time of printing by the ink jet head 15 is provided at the left end of the body 11.

Figure 2:
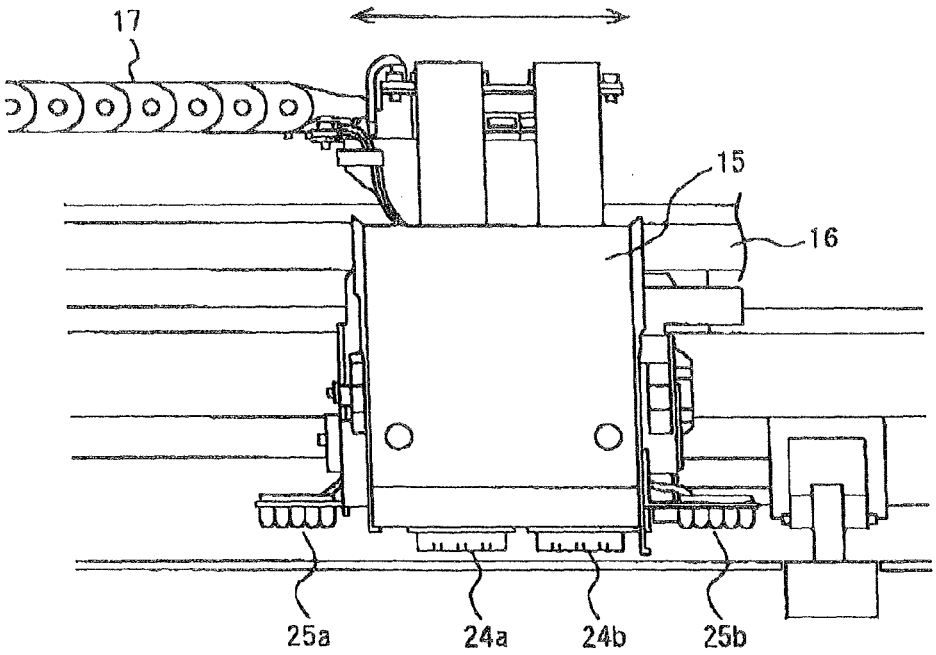
FIG. 2 is a view showing a state in which the ink jet printer is performing printing.

Then, the ink jet head 15 is described. FIG. 2 is a front view showing an essential part of the ink jet head 15. Referring to FIG. 2, the ink jet head 15 is driven by a motor (not shown) through a driving chain 17 along the guide rail 16 in the secondary scanning direction (longitudinal direction shown by an arrow in FIG. 2). Meanwhile, the sheet to be printed is conveyed while pushed by a pinch roller (not shown) in the scanning direction (the direction toward a sheet) which crosses the secondary scanning direction at right angles.

The ink jet head 15 has ink jet nozzles 24 outputting the ultraviolet curing ink, and ultraviolet irradiation LEDs 25*a* and 25*b* provided on the moving direction side of the ink jet head 15 with respect to the ink jet nozzle 24. The ink jet nozzles 24 comprises an ink jet nozzle 24*a* outputting black ink and an ink jet nozzle 24*b* outputting color ink. In addition, FIG. 2 shows a state in which the ink jet head 15 is performing printing.

Then, a capping unit 30 protecting the ink jet head 15 is described. The capping unit 30 is provided on one end, on the side of the operation panel 13, for example of the body 11 of the ink jet printer 10.

Figure 3:
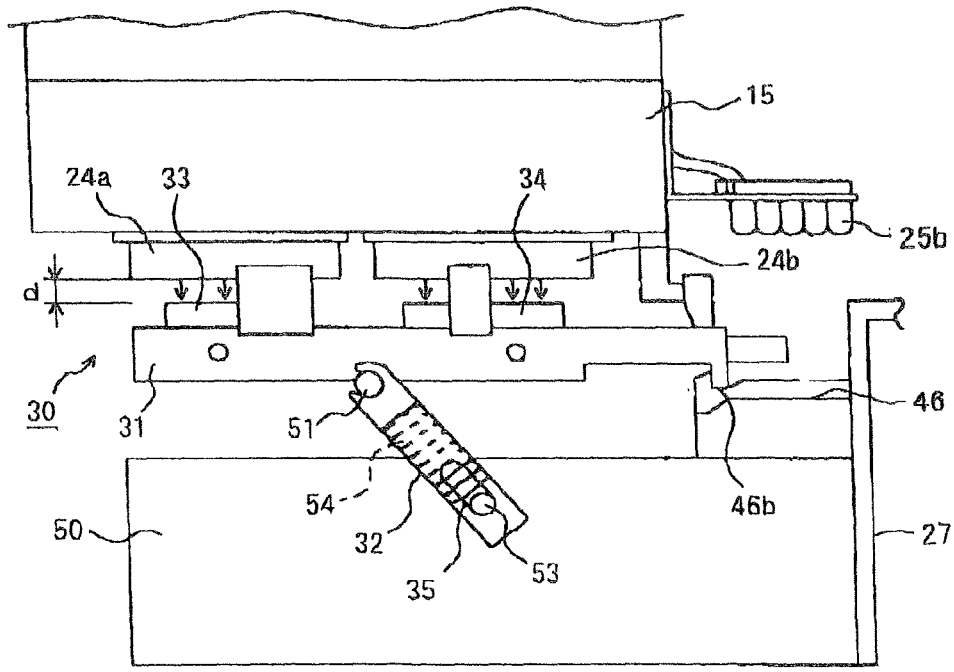
FIG. 3 is a view showing a state in which a nozzle is separated from a capping unit at a capping position.

FIG. 3 is a view showing a detail of the capping unit 30 and a state in which the ink jet nozzle is separated from the capping unit 30. Referring to FIG. 3, the capping unit 30 comprises a board 50 provided in contact with a side end 27 of the operation panel 13 of the body 11, a shaft 53 provided in the board 50, a lever 32 swingably connected to the shaft 53 through an elongate hole 35, and a slider 31 connected to the lever 32 through a shaft 51 and constituted so as to receive the ink jet nozzle 24 when the ink jet head 15 is moved toward the capping unit 30.

Figure 4:
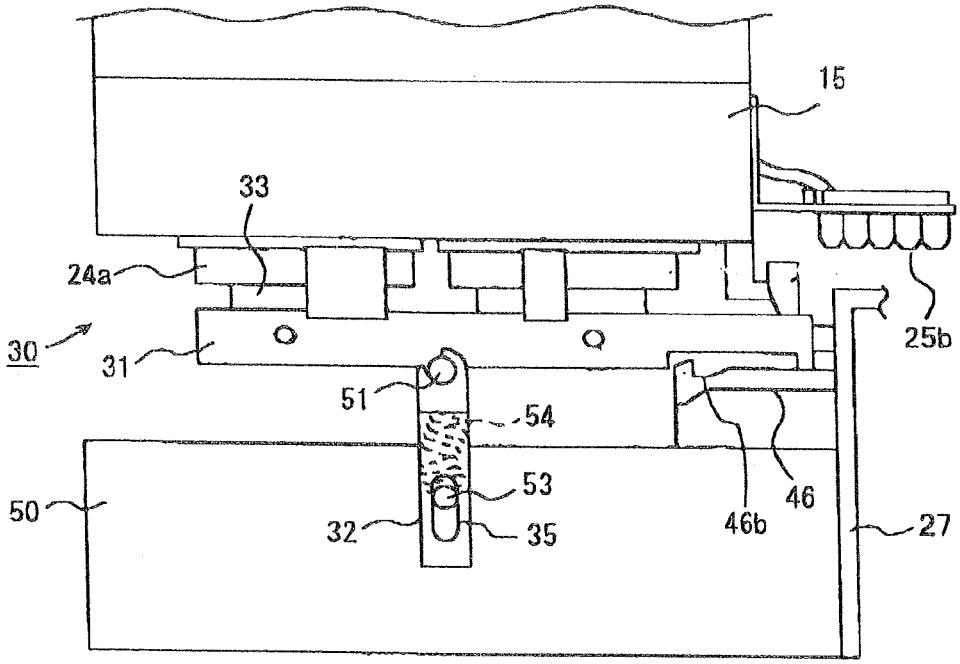
FIG. 4 is a view showing a state in which the nozzle is covered by the capping unit at the capping position.

The capping unit 30 is constituted such that when the ink jet head 15 is moved toward the capping unit 30 provided at the end of the body 11, the slider 31 lifts up by movement of the slider 31 and rotation of the lever 32, and capping members 33 and 34 provided on the slider 31 are attached to the ink jet nozzles 24*a* and 24*b* of the ink jet head 15 (FIG. 4).

The slider 31 is mounted on an upper end of a coil spring 54 having a lower end fixed to the board 50 and slanting to the side of a printing region and set in a buckled state on the side of a non-printing region (on the side of the end 27).

Thus, in the non-capping state, as shown in FIG. 3, the slider 31 having one end regulated by a lowermost end of a slanting surface 46*b* of a guiding member 46 and a middle part regulated by the lever 32 is forced toward the printing region side by the coil spring 54, so that it can maintain a position in which a distance "d" which is suitable for air jetting can be formed without bringing the capping members 33 and 34 into contact with the nozzles 24*a* and 24*b*.

Then, a description is made of a specific arrangement state of the LED elements in the ultraviolet irradiation LED. Basically, since energy allocation at a short wavelength and a long wavelength required for curing the ink depends on the ultraviolet curing ink to be used, it is preferable that the allocation and an amount of the LED elements is set depending on the ink to be used. More specifically, in a case of the ultraviolet ink, a surface of the ultraviolet curing ink is cured at a short wavelength of 250 to 300 nm, and the inside is cured and fixed to a medium at a long wavelength of 300 nm to 370 nm while a dot configuration is maintained. Therefore, an irradiation condition suitable for the ink can be formed by arranging the LED elements to suite the curing reaction wavelength of the ink. Its example is described hereinafter.

Figure 5A:
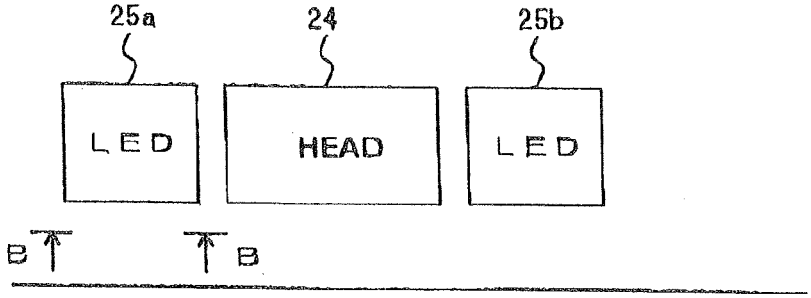
FIGS. 5A and 5B are views showing an exemplary arrangement of ultraviolet irradiation LED elements.
Figure 5B:
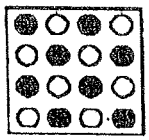
Figure 8:
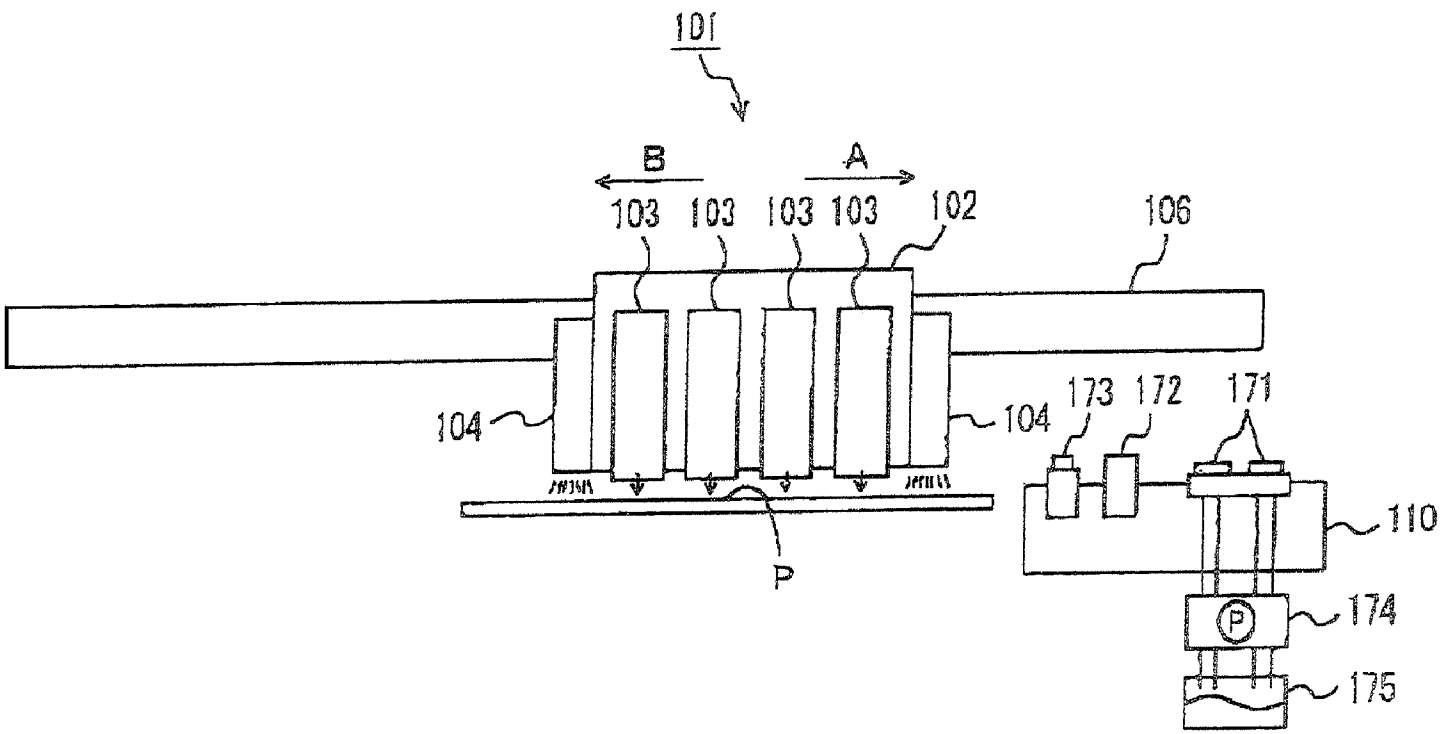
FIG. 8 is a view showing an essential part of the conventional ink jet printer.

FIG. 5 is a schematic view showing the ink jet head 15 shown in FIG. 2 and ultraviolet irradiation LEDs arranged on both sides thereof. FIG. 5(A) is a font view seen from the same direction as in FIG. 2 and FIG. 5(B) is a fragmentary view taken in the direction of arrows B in FIG. 5(A). In the drawing, ● designates a short-wavelength LED element and ○ designates a long-wavelength LED element. Referring to FIG. 5, according to this embodiment, the long-wavelength LED elements and the short-wavelength LED elements are mutually and alternately arranged in the shape of a matrix. This manner can correspond to any ultraviolet curing ink.

FIG. 6 is a view showing another arrangement of the ultraviolet irradiation LED elements. FIG. 6(A) corresponds to FIG. 5(A) and FIG. 6(B) is a fragmentary view taken in the direction of arrows B in FIG. 6(A). In FIG. 6 also, ● designates the short-wavelength LED element and ○ designates the long-wavelength LED element. In this case, the short-wavelength LED elements are arranged on the side close to the ink jet head and the long-wavelength LED elements are arranged on the side apart from the ink jet head.

As described above, since the short-wavelength ultraviolet is for the purpose of curing the surface of the dot and maintaining a dot configuration, they are arranged close to the ink jet head 15 so as to be able to irradiate the ink immediately after outputted.

FIG. 7 is a view showing another arrangement of the ultraviolet irradiation LED elements. Referring to FIG. 7, the short-wavelength LED elements are arranged on both sides of a ink jet head 24 in the secondary scanning direction and the long-wavelength LED elements are arranged in the main scanning direction. Although FIG. 7(A) corresponds to FIG. 5(A), the long-wavelength LED elements are omitted and FIG. 7(B) is a fragmentary view taken in the direction of arrows B in FIG. 7(A). In FIG. 7 also, ● designates the short-wavelength LED element and ○ designates the long-wavelength LED element. In this case, the short-wavelength LED elements are arranged in the secondary scanning direction (direction shown by "a" in the drawing) which is the moving direction of the ink jet head 15 so as to emit the short-wavelength ultraviolet immediately after the printing by the ink jet head 15, and the long-wavelength ultraviolet is emitted after the ink jet head was moved in the main scanning direction (direction shown by "b" in the drawing).

In the above embodiment, as the wavelength of the LED element which cures the ultraviolet curing ink, the example using two kinds of long wavelength and short length was described. However, there are some ink whose reaction wavelength is one wavelength or three wavelengths. Therefore, other than the two kinds of long and short wavelengths, it is preferable that the LED element which outputs the wavelength suitable for the ink is selected and arranged depending on the required allocation.

Although the description was made of the example in which the LEDs are arranged on both sides of the ink jet head because the description was made of the two-way printing in the above embodiment, the present invention is not limited to this and in a case of single-direction printing, there is provided one lamp on one side of the head. Although the two-way printing can be performed with one lamp, since a printing texture of each pass changes depending on the printing direction, it is preferable that the lamp is provided on each side of the head.

Although the ink jet printer was described in the above embodiment, the present invention is not limited to this and may be applied to an ink jet printer serving as also a cutter.

Although the present invention was described with reference to the drawings above, the present invention is not limited to the illustrated embodiments only. Various modifications and variations can be added in the same or an equivalent range of the present invention.

Since the LED is used as a light source irradiating the ultraviolet curing ink, it needs a power not so much as the conventional one and it does not have heat, so that a rubber does not deteriorate by the heat. As a result, it can be advantageously used in the ink jet printer using the ultraviolet curing ink.

What is claimed is:

1. An apparatus comprising:

a printer head configured to eject ink;

a first set of light emitting diode (LED) elements including LED elements of a first wavelength arranged in rows and columns; and a second set of light emitting diode (LED) elements including LED elements of a second wavelength arranged in rows and columns, wherein at least one of the first set of LED elements is adjacent to at least one of the second set of LED elements, the first set of LED elements and the second set of LED elements being disposed near the printer head, and wherein the first wavelength is shorter than the second wavelength, the first set of LED elements being disposed closer to the printer head than the second set of LED elements.

2. An apparatus according to claim 1, wherein the LED elements of the first wavelength and the LED elements of the second wavelength are arranged in an alternating pattern.

3. An apparatus according to claim 1, wherein a plurality of LED elements of the first set of LED elements are adjacent to a plurality of LED elements of the second set of LED elements.

4. An apparatus comprising:

a printer head configured to eject ink;

a first set of light emitting diode (LED) elements including LED elements of a first wavelength arranged in rows and columns; and a second set of light emitting diode (LED) elements including LED elements of a second wavelength arranged in rows and columns, wherein the first set of LED elements and the second set of LED elements are block shaped, the first set of LED elements are disposed adjacent to the second set of LED elements, the first wavelength is shorter than the second wavelength, and the first set of LED elements are disposed closer to the printer head than the second set of LED elements.

* * * * *